United States Patent [19]

Ware

[11] Patent Number: 4,483,440

[45] **Date of Patent: * Nov. 20, 1984**

[54] DISPOSAL DEVICE WITH DISPLAY PANELS

[76] Inventor: Richard L. Ware, 433 E. Hardy, Apartment A, Inglewood, Calif. 90301

[ * ] Notice: The portion of the term of this patent subsequent to Nov. 20, 2000 has been disclaimed.

[21] Appl. No.: 316,129

[22] Filed: Oct. 29, 1981

Related U.S. Application Data

[63] Continuation-in-part of Ser. No. 160,955, Jun. 19, 1980.

[51] Int. Cl.[3] ..... B65D 83/00; B65D 25/54; B65D 5/72

[52] U.S. Cl. ..... 206/233; 206/45.34; 206/216; 206/459; 220/404; 220/20

[58] Field of Search ..... 206/216, 233, 553, 45.34, 206/459, 554, 494; 220/20, 404

[56] References Cited

U.S. PATENT DOCUMENTS

| | | | |
|---|---|---|---|
| 2,007,042 | 7/1935 | Duckett | 206/233 |
| 2,757,859 | 8/1956 | Holland | 220/404 |
| 2,916,183 | 12/1959 | Ariens | 220/404 |
| 3,089,583 | 5/1963 | White | 220/20 |
| 3,848,943 | 11/1974 | Geesaman et al. | 206/553 |
| 4,022,319 | 5/1977 | Jenkins | 206/233 |
| 4,195,729 | 4/1980 | Macken | 206/45.34 |

*Primary Examiner*—William T. Dixson, Jr.

[57] ABSTRACT

The disclosure relates to a disposal device for gum and the like having a generally cubical housing, a disposable bag removably supported therein, and appropriate access openings for gum disposal and bag removal. Each of the side walls of the housing is formed with a slot therein for the insertion of a sheet of advertising or other printed display material. The side walls are made of transparent or clear plastic material for best viewing the display material.

The housing includes a recess in one of the side walls for holding a packet of wrapping tissues for the sanitary disposal of spent chewing gum. A turntable supports the housing for easy rotation on a table top, such that the side wall mounted tissues may be brought within convenient reach, and the display panels may be readily viewed by many persons seated at the same table.

1 Claim, 3 Drawing Figures

Fig. 1
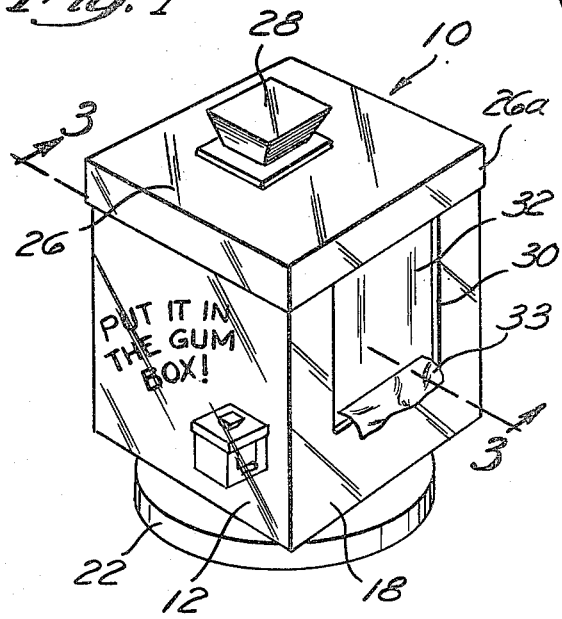
Fig. 2
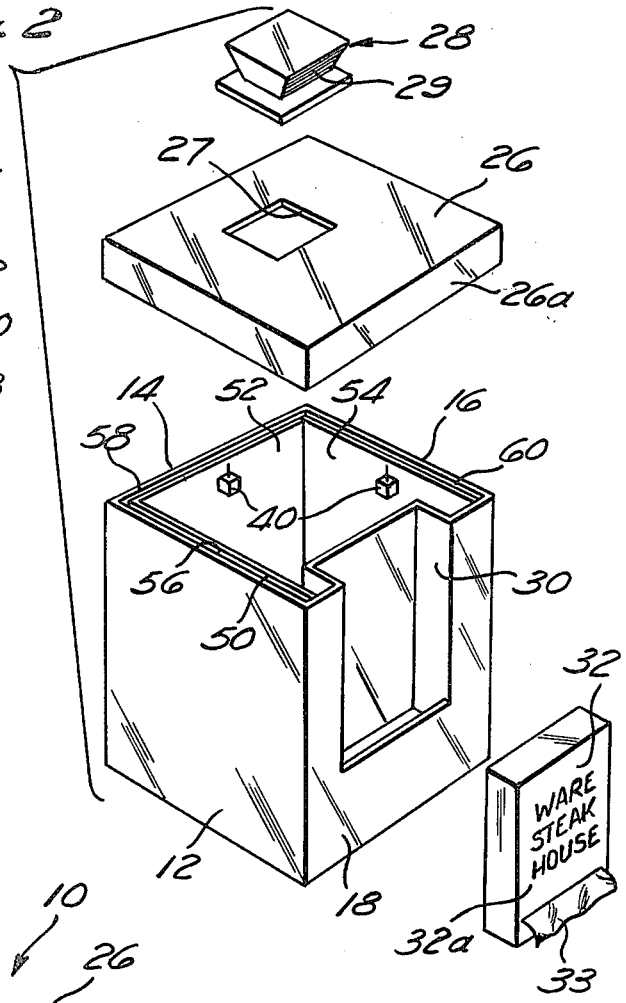
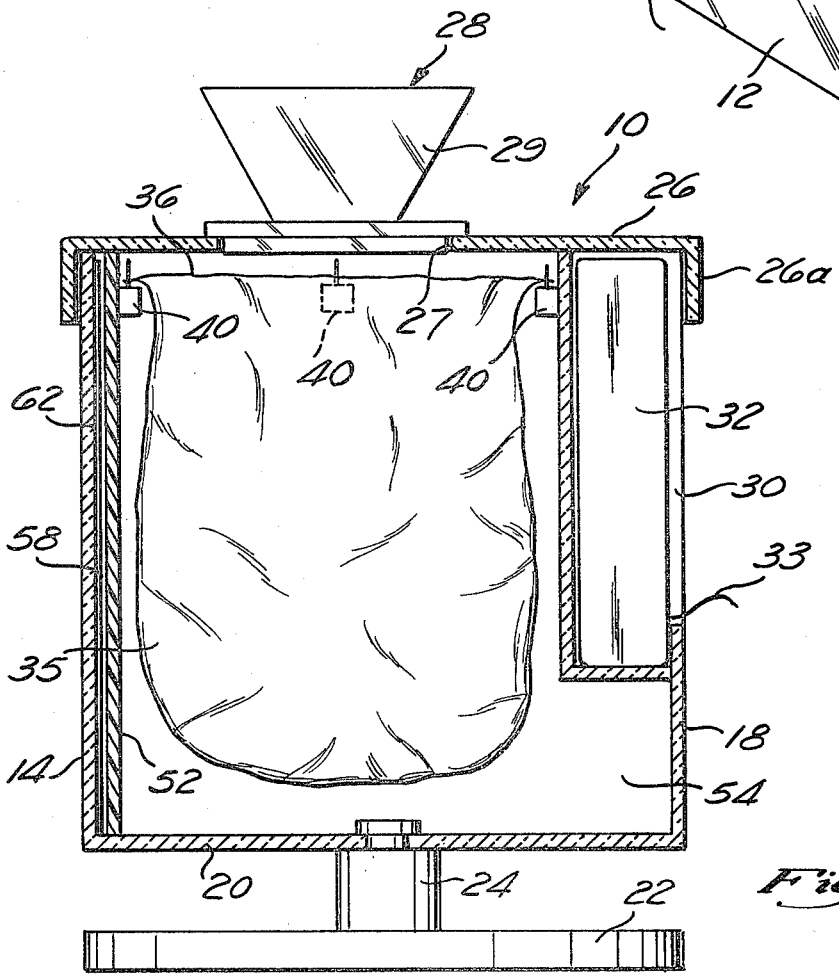
Fig. 3

DISPOSAL DEVICE WITH DISPLAY PANELS

CROSS-REFERENCE TO RELATED APPLICATION

This application is a continuation-in-part of pending patent application Ser. No. 160,955 entitled "Improved Chewing Gum Disposal Device", filed June 19, 1980.

BACKGROUND OF THE INVENTION

A. Field of the Invention

This invention generally pertains to the field of waste disposal devices and containers and is more particularly related to devices for the disposal of chewing gum.

B. Prior Art

Various receptacles and devices for the disposal of spent chewing gum are known. Exemplary of these are the following described patents.

U.S. Pat. No. 2,757,859 to Holland shows a chewing gum disposer having a sliding top plate which in one position exposes a top opening through which the gum discards may be deposited into a sack suspended within a container. U.S. Pat. No. 3,836,037 to Bass, U.S. Pat. No. 2,796,309 to Taylor, and U.S. Pat. No. 1,974,630 to Sessler show sanitary containers comprising a disposible bag suspended with an exterior housing. Bass and Sessler disclose separate top and side access doors. Taylor includes a side pocket for storing a supply of paper bags.

U.S. Pat. No. 4,022,319 to Jenkins discloses a gum disposal device in which a tissue wrapper compartment is made part of the device, and also has various access openings for gum disposal and removal.

The invention disclosed herein is superior to the prior art gum disposal devices of which I am aware in having, in a rotatable device, side display panels as part of the device itself, as will be described in more detail hereafter.

SUMMARY OF THE INVENTION

The gum disposal device comprises a box having preferably, three, four or five side walls and a floor member. The box is mounted for rotation on a base member. One of the side walls is provided with a recess means for containing gum wrappers, and the remaining side walls are each formed with a thin vertical, open-ended slot for the purpose of retaining printed display sheet material therein. The exterior surface of the side walls containing the display material is transparent so that the display material contained therein is visually apparent.

The combination of a gum disposal box having slotted side walls for retaining a plurality of readily removable and insertable display panels is a substantial advance in this art.

BRIEF DESCRIPTION OF THE DRAWINGS

FIG. 1 is a perspective view of the assembled gum box of this invention;

FIG. 2 is an exploded view, in perspective, of the gum box of this invention; and FIG. 3 is a side elevational view, in cross-section, taken along the line 3—3 of FIG. 1.

DETAILED DESCRIPTION OF THE INVENTION

FIG. 1 depicts a gum box 10 of this invention, the major component parts of which are the four side walls

12, 14, 16 and 18, all supported by a floor member 20, a base member 22 and upstanding stem 24 rotatably engaging with the floor member 20, a removable roof member 26 having an access opening 27 and a depending skirt 26*a* formed therein, and a cover member 28 interfitting with access opening. The cover member 28 has a handle portion 29 for easy removal and placement thereof relative to access opening 27. The cover member may also be in the form of a conventional spring-loaded cover plate (not shown).

Side wall 18 is formed with a recess 30 for a gum wrapper box 32. The gum wrapper box 32 is nested within the recess 30 and retained therein by means of skirt 26*a* depending from roof member 26, as shown in FIGS. 1 and 3, in particular. The wrappers 33 are dispensed individually from the bottom of the gum wrapper box 32. The box 32 may also contain advertising subject matter on the exposed surface 32*a* thereof.

In order to make the gum disposal box 10 as attractive to use as possible, the applicant has devised an additional use for the box—as an advertising medium, by simply adding to the interior box 10, internal wall members 50, 52, 54 thereby creating a plurality of thin, vertical, open-ended slots 56, 58, 60. Advertising, or other printed display materials, e.g., display sheet 62, are readily inserted into any of slots 56, 58, 60, by slipping the sheet 62 into the open upper end of any of said slots 56, 58, or 60. The sheet is supported in the slot by means of the adjacent side wall and internal wall members. During normal use of the device, the display sheets are retained in the slots by overlying roof member 26. The display material is easily removed from its slot by removing the roof member 26 allowing access to, and retrieval of, the display sheet.

The interior of the box 10 contains a disposable top-opening, flexible plastic bag 35 for gum and other trash, the mouth 36 of the bag 35 being in the open position just below the upper end of the gum disposal box 10 by having a plurality of points on its peripheral edge secured to the internal side walls 50, 52, 54 of the box 10 by pin means 40 or the like.

Because of the rotatable mounting of the gum box 10, the display materials in any of slots 56, 58 and 60 are readily viewable by all persons seated at a table. Further, the tissue box 32 is brought within convenient reach from any angle.

The tissues or sheet wrappers 33 may be made of paper, waxed paper, metallic foil, or nylon or plastic sheeting. Combinations of these materials may also be used for this purpose. The tissues 33 are provided for use as a carrier means for sanitarily receiving spent chewing gum from a person's mouth and for wrapping around the spent gum for the sanitary disposal thereof.

Various changes and modifications within the scope and spirit of this invention will occur to those skilled in the art. Therefore applicant intends to be bound only by the claims which follow.

I claim:

1. In a waste disposal and display device, a top opening for waste disposal and the like contained within a plurality of external side walls, a floor member supporting said side walls and a removable cover member, the improvements which comprise, in combination:

one of said external side walls being provided with a recess therein;

a waste wrapper box nested within said recess;

a plurality of internal wall members parallel to and closely adjacent to the remaining external side walls, said internal wall members and said remaining external side walls defining a plurality of thin, generally vertically extending, open-ended slots for insertion therein of printed display sheets and the like;

means for removably securing an inner flexible liner, in an open position, within said internal wall members; and a support means rotatably supporting said floor member of said gum disposal device.

* * * * *